US007225547B2

(12) United States Patent
Lüttgens

(10) Patent No.: US 7,225,547 B2
(45) Date of Patent: Jun. 5, 2007

(54) PENCIL SHARPENER

(75) Inventor: Fritz Lüttgens, Erlangen (DE)

(73) Assignee: KUM Limited, Trim, Co. Meath (IE)

( * ) Notice: Subject to any disclaimer, the term of this patent is extended or adjusted under 35 U.S.C. 154(b) by 95 days.

(21) Appl. No.: 10/850,925

(22) Filed: May 21, 2004

(65) Prior Publication Data

US 2005/0257387 A1 Nov. 24, 2005

(51) Int. Cl.
*B43L 23/08* (2006.01)

(52) U.S. Cl. ..... 30/457; 30/454; 30/461

(58) Field of Classification Search ..... 30/451, 30/454, 457, 458, 459, 460, 461; 144/28.1, 144/28.11, 28.2
See application file for complete search history.

(56) References Cited

U.S. PATENT DOCUMENTS

| | | | | | |
|---|---|---|---|---|---|
| 486,470 | A | * | 11/1892 | Humphries | 30/458 |
| 1,601,118 | A | * | 9/1926 | Hassenfeld | 30/457 |
| 1,887,422 | A | | 11/1932 | Oulton | 30/459 |
| 4,248,283 | A | * | 2/1981 | Kaye | 30/454 |
| 4,620,558 | A | | 11/1986 | Lüttgens | 30/454 |
| 5,379,817 | A | | 1/1995 | O'Neil et al. | 144/363 |
| 6,301,791 | B1 | * | 10/2001 | Luttgens | 30/454 |
| 6,494,638 | B1 | * | 12/2002 | Donaldson | 403/347 |
| 2005/0138819 | A1 | | 6/2005 | Co | 30/457 |

FOREIGN PATENT DOCUMENTS

| | | |
|---|---|---|
| DE | 606 888 | 12/1934 |
| DE | 668 717 | 12/1938 |
| DE | 27 43 120 A1 | 3/1979 |
| DE | 199 52 039 A1 | 5/2001 |
| FR | 1.068.481 | 6/1954 |

* cited by examiner

*Primary Examiner*—Hwei-Siu C. Payer
(74) *Attorney, Agent, or Firm*—Laurence A. Greenberg; Werner H. Stemer; Ralph E. Locher

(57) ABSTRACT

A compact sharpener (1) for a pencil (S), the sharpener being cost-effective to realize and being particularly suitable for sharpening a cosmetic pencil in particular, comprises a sharpener body (2) and a shaving blade (3) fastened thereon. The sharpener body (2), in turn, comprises a guide sleeve (4) and a blade holder (5) integrally formed on the guide sleeve (4), the guide sleeve (4) having a bore (6) which defines a pencil-guiding channel (7) and has an introduction end (8) and an outlet end (9) for the pencil (S), and the blade holder (5) having a bearing surface (15) which is positioned obliquely in relation to the axis (11) of the pencil-guiding channel (7), projects axially beyond the outlet end (9) of the guide sleeve (4) and is intended for positioning the shaving blade (3).

3 Claims, 6 Drawing Sheets

PENCIL SHARPENER

BACKGROUND OF THE INVENTION

Field of the Invention

The invention relates to a sharpener for a pencil, in particular a cosmetic pencil.

A sharpener is usually used in order to sharpen the core of a pencil and, in the process, to shave off any core casing which may be present. A sharpener customarily has an approximately cuboidal sharpener body into which an essentially circular-conical sharpening cone is introduced, as a guide for the pencil tip, such that its lateral surface is approximately tangent to an outer surface of the sharpener body. In the vicinity of this tangent, the sharpening cone is open, via a shaving-discharge slot, in the direction of the abutting outer surface of the sharpener body. A sharpener also comprises a shaving blade which is fastened on the sharpener body tangentially in relation to the lateral surface of the sharpening cone and projects into the shaving-discharge slot by way of a cutting edge, with the result that, when a pencil which has been pushed into the sharpening cone is rotated in relation to the sharpener body, a shaving is removed from the pencil by the cutting edge of the shaving blade.

In addition to pencils with a hard core material, use is often made of pencils with a soft, plastic core. Cosmetic pencils in particular are usually included in these so-called soft-core pencils. When a soft-core pencil is sharpened, there is a greater problem of the soft core material which has been shaved off remaining stuck in the sharpening cone or on the shaving blade and forming clump-like residues. This may result in soiling or smearing of the pencil surface during the sharpening operation, or even in the sharpening cone being blocked or in the sharpening function being adversely affected in some other way, and is therefore undesirable.

Special sharpeners for soft-core pencils are thus often provided with a comparatively wide shaving-discharge slot and/or a sharpening-cone opening opposite the sharpener blade, in order to facilitate the discharge of the core substance and to render the shaving blade and the tip of the sharpening cone more easily accessible for cleaning purposes.

SUMMARY OF THE INVENTION

The object of the invention is to specify a particularly compact sharpener which can be produced cost-effectively and is particularly advantageous in conjunction with a cosmetic pencil in particular.

This object is achieved according to the invention in a sharpener for a pencil, having a sharpener body and a shaving blade fastened thereon:

the sharpener body comprising a guide sleeve and a blade holder integrally formed on the guide sleeve;

the guide sleeve having a bore which defines a pencil-guiding channel and has an introduction end and an outlet end for the pencil; and the blade holder having a bearing surface which is positioned obliquely in relation to the axis of the pencil-guiding channel, projects axially beyond the outlet end of the guide sleeve and is intended for positioning the shaving blade.

In other words, the sharpening body comprises a guide sleeve and a blade holder integrally formed on this guide sleeve.

The guide sleeve has a bore passing through it, which defines a pencil-guiding channel. In contrast to the sharpening cone of a conventional sharpener, this bore is of such a nature that a pencil which has been introduced into the sharpening position passes right through the guide sleeve and at least part of the pencil tip projects out again on the side which is opposite the introduction side. The guide sleeve and, in particular, the bore thereof, thus have an introduction end and an opposite outlet end for the pencil along the axis of the bore. The pencil-guiding channel referred to is the volume which a pencil which is to be sharpened takes up, in the sharpening position, inside and outside the guide sleeve. The pencil-guiding channel is obtained from the inner volume of the bore and the imaginary extension of the latter into the space located outside the guide sleeve.

A bearing surface for the shaving blade is arranged on the blade holder such that the shaving blade positioned thereon projects axially beyond the outlet end of the guide sleeve and is positioned obliquely in relation to the axis of the pencil-guiding channel. The shaving blade here is oriented in relation to the axis of the pencil-guiding channel, in particular, such that the cutting edge of the shaving blade approximately forms a line which intersects the axis of the pencil-guiding channel.

The invention is based on the idea of reducing the body of a sharpener to the bare essentials. The essentials here are regarded as being the wall of a pencil-guiding channel and a bearing surface, suitably positioned in relation to the same, for the shaving blade. According to the invention, the wall of the pencil-guiding channel is provided by the guide sleeve, and the bearing surface is expediently provided by the blade holder integrally formed on the guide sleeve.

The sharpener body formed in this way is both of particularly material-saving design and is straightforward to produce from a manufacturing point of view. In particular, the sharpener body formed from the guide sleeve and the blade holder can be produced particularly cost-effectively as a metal casting or a polymer-material molding, especially since a comparatively straightforward and thus inexpensive mold can be used for this purpose. On the other hand, the abovedescribed design of the sharpener body has the effect of the sharpener blade and the pencil tip being largely exposed during the sharpening operation. The blade holder preferably encloses the pencil-guiding channel merely over a circumferential-angle range of approximately 90°, with the result that the pencil-guiding channel is not bounded by enclosing walls over a circumferential-angle range of approximately 270° in the region of the pencil tip. As a result, blockage of the sharpener and other instances of malfunctioning caused by adhering core substance of a soft-core pencil are avoided in a particularly effective manner.

In order to ensure that a pencil which is to be sharpened is guided to good effect along the axis of the pencil-guiding channel, it is expediently the case that, at least in a portion which is adjacent to the introduction end, the bore of the guide sleeve is of cylindrical configuration, in adaptation to the preferred pencil diameter. In the region of the outlet end, in contrast, a bore portion which tapers conically in the direction of the same is preferably provided, this bore portion forming a stop for the pencil and thus ensuring uniform, controlled shaving removal.

In a material-saving configuration of the invention, it is provided that the guide sleeve has a cross-sectionally circular outer circumference. In contrast, however, it is also possible for the outer circumference of the guide sleeve to be of, for example, polygonal configuration.

An essentially wedge-shaped design of the blade holder is advantageous in respect of both the stability and of straightforward production capability of the sharpener body, the wedge slope forming the bearing surface for the shaving blade. The blade holder here has the wedge base, i.e. the high wedge end, integrally formed on a circumferential region of the guide sleeve, with the result that the longitudinal axis of the wedge is offset from, approximately parallel to, the axis of the pencil-guiding channel and the horizontal surface of the wedge is located approximately in a single plane with this axis.

In a preferred configuration of the invention, at least one supporting wing is integrally formed on the circumference of the guide sleeve, this supporting wing projecting essentially radially from the guide sleeve—as seen in the viewing direction along the axis of the pencil-guiding channel. Two such supporting wings are preferably provided, these being arranged opposite one another on the circumference of the guide sleeve. In a manner similar to the wings of a wing nut, the supporting wing or wings allow simplified manual operation of the sharpener. The supporting wing or wings, furthermore, also serve for the straightforward and advantageous fixing of the sharpener body in a shaving-collecting housing or for clamping the sharpener body in the drive mechanism of a crank-handle-operated or motor-operated automatic sharpener. In the latter case, the sharpener according to the invention forms an inexpensive shaving unit for the automatic sharpener.

A supporting wing is expediently integrally formed on the guide sleeve in the region of the blade holder, with the result that the blade holder is integrated in the supporting wing. Furthermore—likewise analogously to the wings of a wing nut—the supporting wing or wings are preferably guided from the guide sleeve in the rearward direction, i.e. in the axial direction, beyond the outlet end of the guide sleeve. In this configuration, the supporting wing or wings flank the shaving blade and thus shield it against accidental contact with the cutting edge.

In a further configuration, which is advantageous in particular in respect of the stability of the sharpener body, the ends of two supporting wings which are directed away from the guide sleeve are connected to one another, with the result that the supporting wings form a closed supporting frame. In a particularly preferred form of such a supporting frame, the ends of the supporting wings which are directed away from the guide sleeve are not connected directly to one another. Rather, the end of each supporting wing which is directed away from the guide sleeve is, in turn, integrally formed on the circumference of a second sleeve, which is arranged coaxially with the guide sleeve and is provided as an insertion sleeve for the drive shaft of an automatic sharpener. This insertion sleeve is preferably provided with an essentially central bore which has a non-circular cross section, in order to allow form-fitting torque transmission from the drive shaft to the sharpener body. A bore with a cross section in the form of a polygon or circle segment is particularly suitable in this respect.

An essential advantage of the sharpener described is that it can be used multifunctionally with the same sharpener body, on the one hand as an open manual sharpener, and on the other hand, by combining the sharpener body with a shaving-collecting housing, as a housing-type sharpener and, in addition, as an inexpensive cutting unit of an automatic sharpener.

A shaving-collecting housing which is advantageous for securing the sharpener body comprises at least one guide groove in which a corresponding supporting wing of the sharpener body is positioned in a form-fitting manner. In a construction which is advantageous, in particular, for a particularly narrow shaving-collecting housing, provision is made for the sharpener housing to be pushed into the shaving-collecting housing along the or each guide groove. In an alternative configuration of the shaving-collecting housing, a border of the guide groove is designed as a latch-on nose. In this embodiment, the sharpener body is latched into the or each guide groove, by way of the supporting wing or the supporting wings, perpendicularly to this guide groove.

The extremely compact size of the sharpener body also allows the sharpener housing to be realized in a very compact manner. This is highly advantageous, in particular, in the case of a sharpener provided for sharpening cosmetic pencils, especially since the compact size of the shaving-collecting housing makes it easier for the sharpener to be readily carried along in a pocket, etc. In a further advantageous configuration of the invention, a plurality of sharpener bodies are combined in a common housing. It is expedient here in particular for sharpener bodies which are designed for different pencil diameters to be combined with one another. However, it is also conceivable to combine sharpener bodies made of different materials, in particular polymer material and metal.

It is further conceivable for a shaving-collecting housing designed for accommodating a sharpener body to be formed such that different sharpener bodies can optionally be exchanged for one another.

Instead of the insertion sleeve, an advantageous development of the invention provides a protective cap which can be positioned on the pencil tip. In this configuration, on the one hand, the sharpener can always be kept together with the pencil and is thus immediately to hand if required. On the other hand, the sharpener, in its additional function of protective cap, simultaneously serves for protecting the pencil core.

The protective cap and the actual sharpener body are preferably open on axially opposite sides, so that all that is required is for the sharpener to be turned round in order to be used optionally for sharpening purposes or as a protective cap. The protective cap performs its protective function to a particular extent if it is closed at the end which is directed toward the guide sleeve.

The protective cap preferably encloses the pencil circumference in an air-tight manner, in order to prevent the core from drying out. This is the case, in particular, with cosmetic pencils, of which the core substance often has a particularly high water content. For this purpose, on an inner portion which is adjacent to its introduction opening, the protective cap is preferably provided with a sealing cone which tapers slightly and, when the pencil is introduced, positions itself with sealing action against the pencil circumference. The protective cap expediently consists of an elastic material, in particular a polymer material.

BRIEF DESCRIPTION OF THE DRAWINGS:

Exemplary embodiments of the invention are explained in more detail hereinbelow with reference to a drawing, in which.

Figure 1:
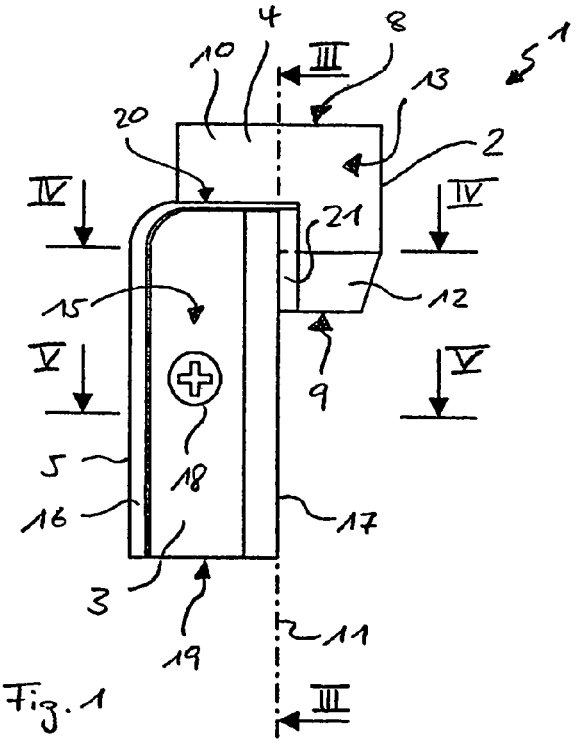
FIG. 1 shows, in a plan view of the shaving blade, a sharpener having a sharpener body comprising a guide sleeve and a blade holder integrally formed thereon.
Figure 4:
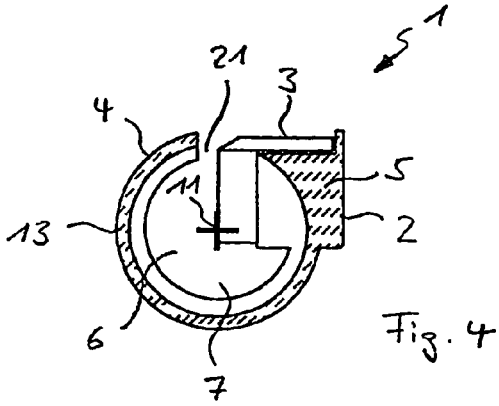
FIG. 4 shows the sharpener according to FIG. 1 in a cross section IV—IV.
Figure 5:
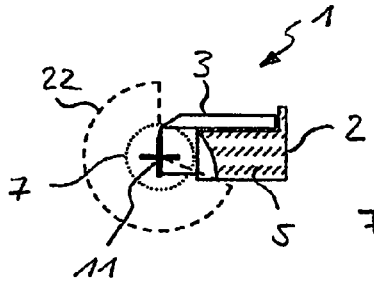
FIG. 5 shows the sharpener according to FIG. 1 in a cross section V—V.

DESCRIPTION OF THE PREFERRED EMBODIMENTS:

Parts which correspond to one another are always provided with the same designations in all the figures.

The sharpener 1, which is illustrated in a first embodiment in FIGS. 1 to 5, comprises a single-piece sharpener body 2, made of polymer material or metal, and a shaving blade 3. The sharpener body 2, in turn, comprises a guide sleeve 4 and a blade holder 5 integrally formed thereon.

The guide sleeve 4 has a central bore 6 passing through it, which defines a pencil-guiding channel 7. The guide sleeve 4 and, in particular, the bore 6 thereof have an introduction end 8, at which a pencil S which is to be sharpened (FIG. 15) can be introduced into the bore 6 during the sharpening operation. That end of the guide sleeve 4, and of the bore 6 thereof, which is axially opposite the introduction end 8, and in relation to which the tip of the pencil S projects out of the guide sleeve 4 again in the sharpening position, is referred to as the outlet end 9. The pencil-guiding channel 7 refers to the volume which the pencil S which is to be sharpened takes up, in the sharpening position, inside and outside the guide sleeve 4.

In a portion 10 of the guide sleeve 4 which is adjacent to the introduction end 8, the bore 6 is of cylindrical configuration, i.e. it is configured, in particular, with a constant diameter. This cylindrical portion 10 serves for ensuring good guidance of the pencil S along the axis 11 of the pencil-guiding channel 7. In a portion 12 of the guide sleeve 4 which is adjacent to the outlet end 9, in contrast, the bore 6 tapers conically in the direction of the outlet end 9. This conical portion 12 of the bore 6 serves as a stop for the pencil S in the sharpening position.

The outer circumference 13 of the guide sleeve 4 can be configured basically as desired. In the exemplary embodiments illustrated, however, the outer circumference 13 of the guide sleeve 4 is always of circular design.

Figure 2:
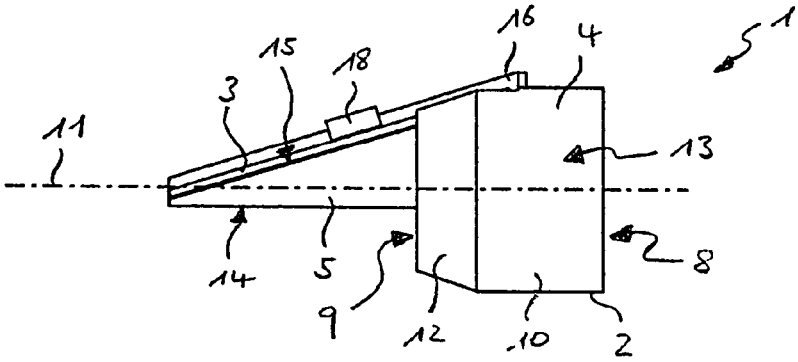
FIG. 2 shows a side view of the sharpener according to FIG. 1.
Figure 3:
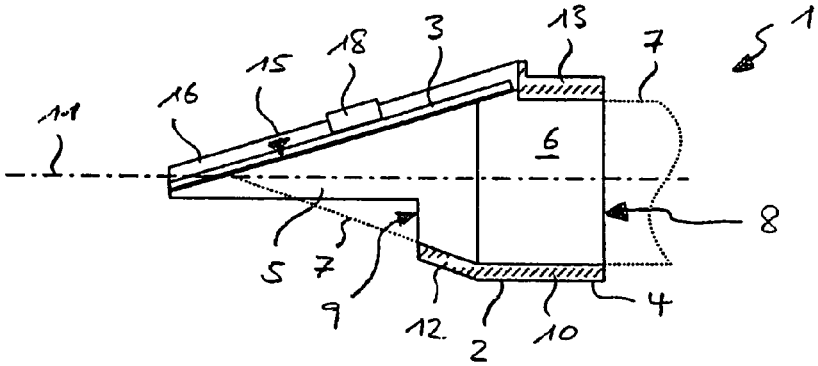
FIG. 3 shows the sharpener according to FIG. 1 in a longitudinal section III—III.

As can be gathered from FIGS. 2 and 3 in particular, the blade holder 5 is essentially in the form of a wedge, of which the horizontal surface 14 is spaced apart by a small distance parallel to the axis 11 of the pencil-guiding channel 7. The sloping surface of the wedge shape, in contrast, forms a bearing surface 15, on which the shaving blade 3 is positioned at an angle in relation to the axis 11. For this purpose, the bearing surface 15 is enclosed, in particular at its border which is directed away from the axis 11, by a railing-like positioning aid 16, against which the shaving blade 3 is positioned. The shaving blade 3, in this position, is oriented such that its cutting edge 17 forms a line which approximately intersects the axis 11. The shaving blade 3 is fixed on the bearing surface 15 by means of a fastening screw 18.

The blade holder 5 has its longitudinal axis arranged offset from, and parallel to, the axis 11, with the result that its wedge tip 19 is directed away from the guide sleeve 4 and the wedge base 20, which is opposite the wedge tip 19, is correspondingly directed toward the guide sleeve 4. In the region of the wedge base 20, the blade holder 5 overlaps with the guide sleeve 4 in an axial region which exceeds the axial length of the conical portion 12 of the guide sleeve 4. As a result of this overlapping, the pencil S is neatly shaved to its outer circumference. In the overlapping region, the guide sleeve 4 is provided with a shaving-discharge slot 21, into which the cutting edge 17 of the shaving blade projects.

Over most of the region of its axial extent, the blade holder 5 projects beyond the outlet end 9 of the guide sleeve 4. In this region, which is illustrated, in particular, in the cross-sectional illustration according to FIG. 5, the shaving blade 3 and the pencil-guiding channel 7 occupied by the pencil S during the sharpening operation hang more or less freely in space. In specific terms, the pencil-guiding channel 7 is enclosed by the blade holder 5 and the shaving blade 3 merely over a circumferential-angle range of slightly more than 90°. Over most of the circumferential-angle range 22 of approximately 250° (indicated by dashed lines in FIG. 5), in contrast, the pencil-guiding channel 7 is open in the outward direction.

Figure 6:
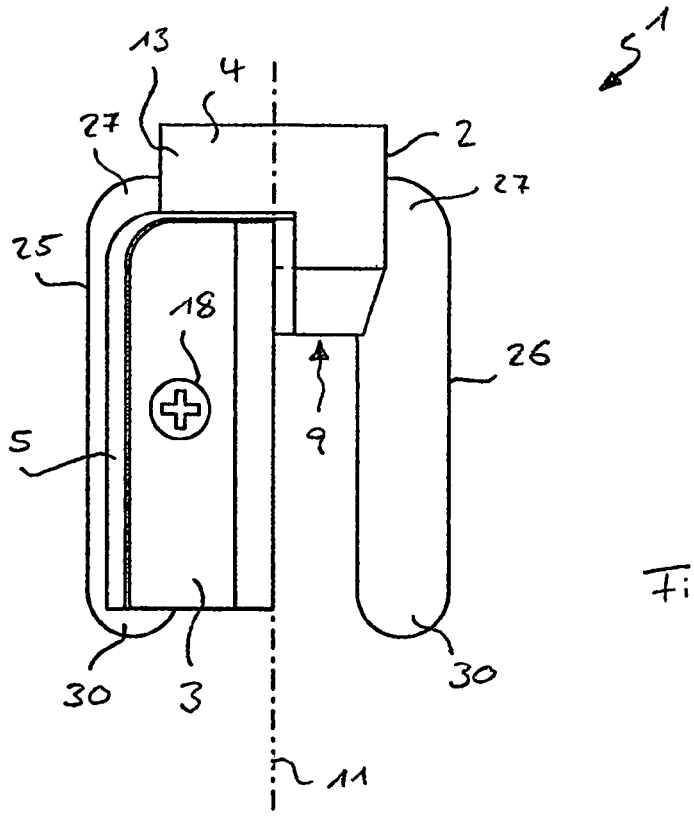
FIG. 6 shows a second embodiment of the sharpener, in an illustration according to FIG. 1.
Figure 7:
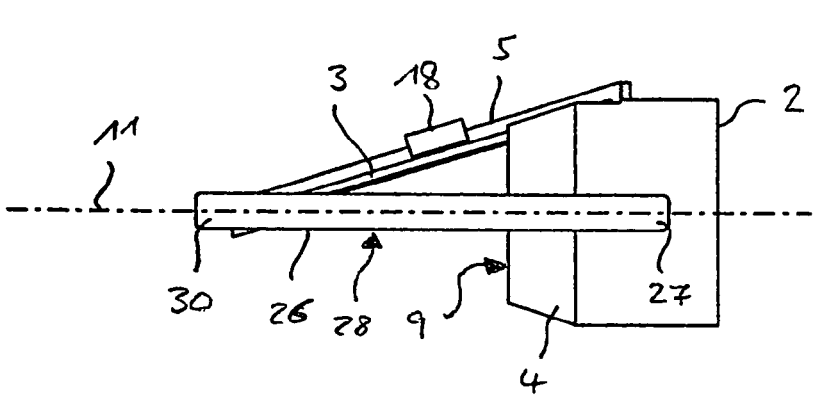
FIG. 7 shows the sharpener according to FIG. 6 in an illustration according to FIG. 2.
Figure 8:
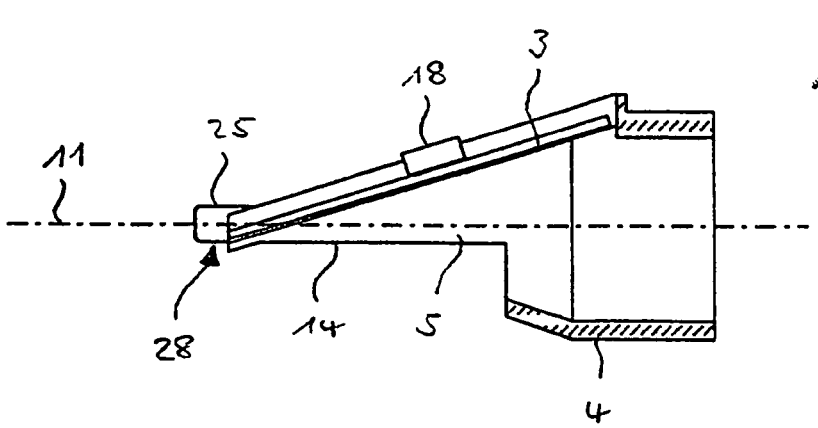
FIG. 8 shows the sharpener according to FIG. 6 in an illustration according to FIG. 3.

FIGS. 6 to 8 illustrate a second embodiment of the sharpener 1. In respect of the guide sleeve 4, the blade holder 5 and the shaving blade 3 positioned thereon, this second embodiment is similar to the abovedescribed embodiment (FIGS. 1 to 5). However, in a second embodiment of the sharpener 1 (FIGS. 6 to 8), the sharpener body 2 additionally has two supporting wings 25, 26, each of which is integrally formed on the outer circumference 13 of the guide sleeve 4 in the region of one end 27 and projects radially from there—as seen in cross section along the axis 11. The two supporting wings 25, 26 here are arranged, in particular, on opposite regions of the circumference of the guide sleeve 4, with the result that the sharpener body 2 is approximately in the form of a wing nut.

Each supporting wing 25, 26 is of elongate, plate-like form with its longitudinal extent oriented parallel to the axis 11. From the end 27 which is directed toward the guide sleeve 4, each supporting wing 25, 26 extends in the direction of the outlet end 9 and beyond the latter. The supporting wings 25, 26 thus flank the blade holder 5 and the shaving blade 3 in the axial direction. The supporting wings 25, 26 are arranged such that a respective bottom surface 28 of each supporting wing 25, 26 is aligned with the horizontal surface 14 of the wedge-shaped blade holder 5. The blade holder 5 is integrated in the supporting wing 25, with the result that the bottom surface 28 of the supporting wing 25 forms a common, continuous surface with the horizontal surface 14 of the blade holder 5.

Figure 9:
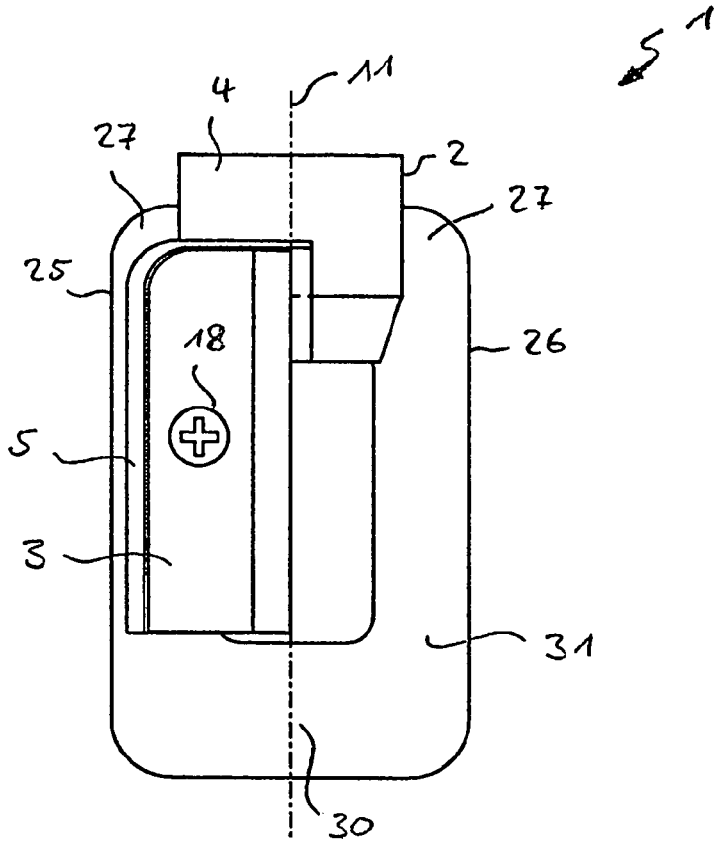
FIG. 9 shows a third embodiment of the sharpener, in an illustration according to FIG. 1.
Figure 10:
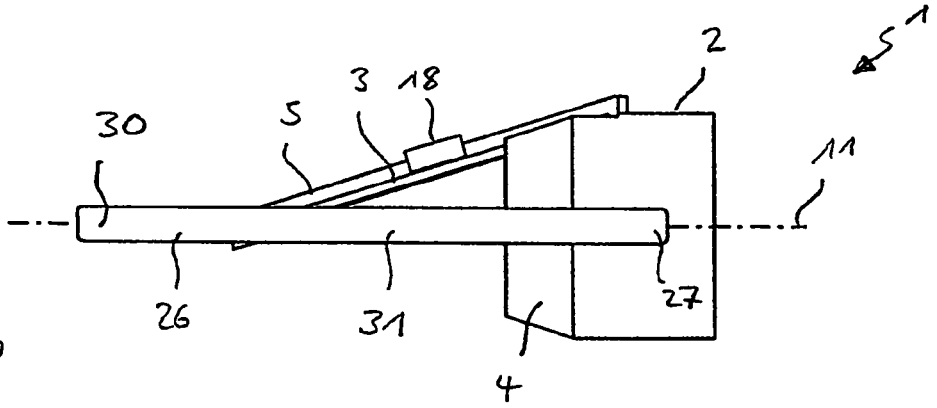
FIG. 10 shows the sharpener according to FIG. 9 in an illustration according to FIG. 2.
Figure 11:
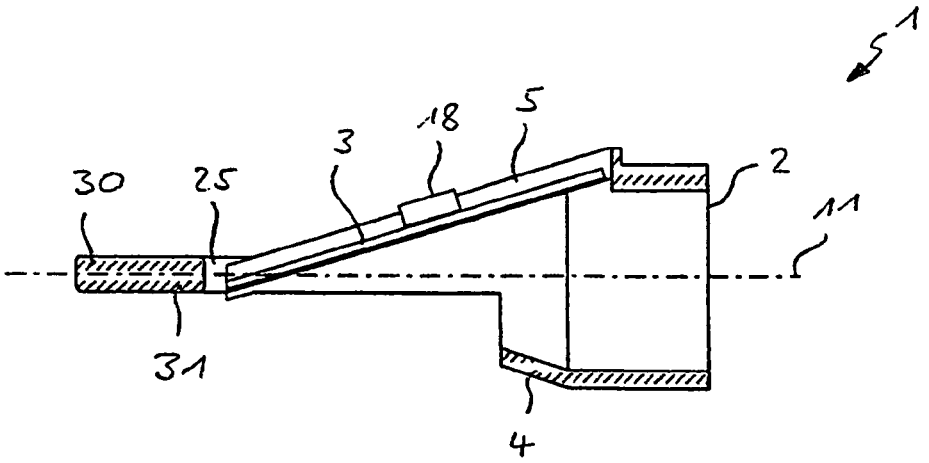
FIG. 11 shows the sharpener according to FIG. 9 in an illustration according to FIG. 3.

FIGS. 9 to 11 illustrate a third embodiment of the sharpener 1. This embodiment, in turn, is similar to the second embodiment (FIGS. 6 to 8), but differs from the latter in that the supporting wings 25, 26 are brought together, and connected integrally to one another, in the region of their end 30 which is directed away from the guide sleeve 4, and is therefore opposite the respective end 27. The supporting wings 25, 26 thus form an essentially rectangular, closed supporting frame 31, in which the blade holder 5 and the guide sleeve 4 are integrated.

Figure 12:
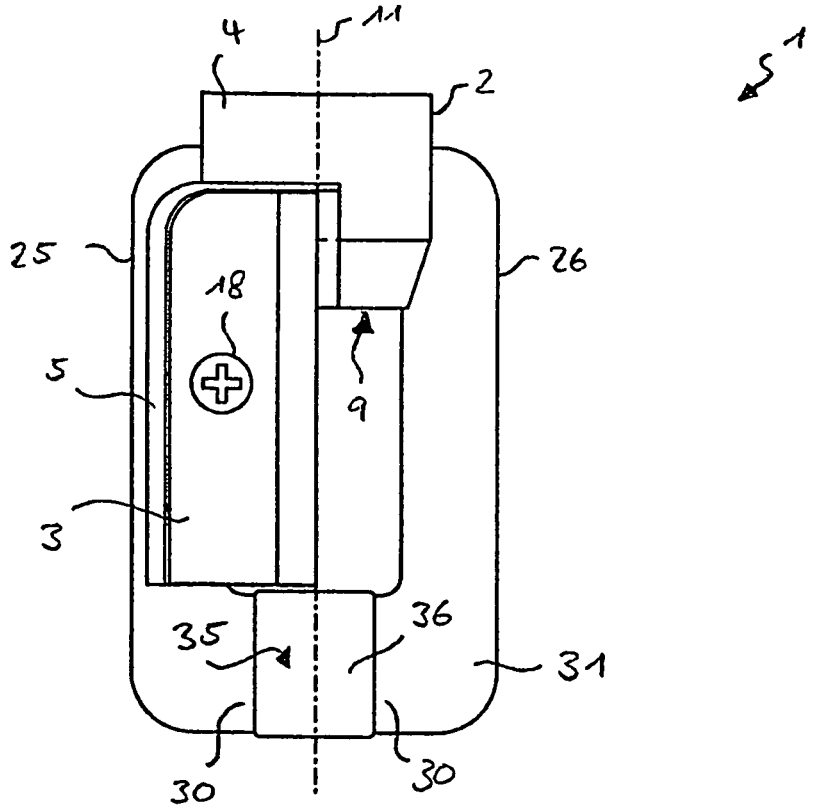
FIG. 12 shows a fourth embodiment of the sharpener, in an illustration according to FIG. 1.
Figure 13:
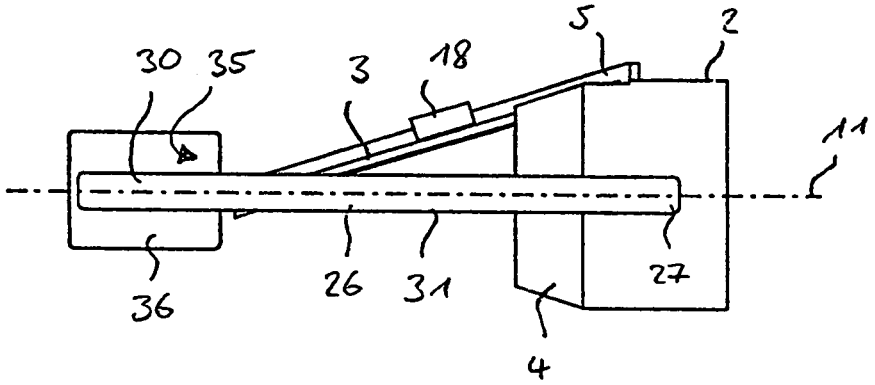
FIG. 13 shows the sharpener according to FIG. 12 in an illustration according to FIG. 2.
Figure 14:
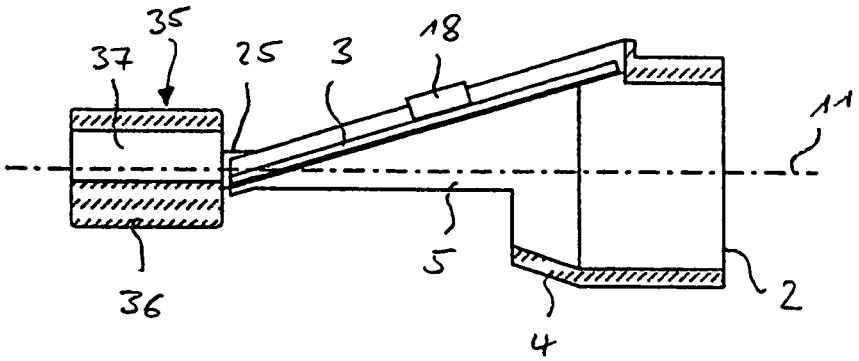
FIG. 14 shows the sharpener according to FIG. 12 in an illustration according to FIG. 3.

FIGS. 12 to 14 illustrate a fourth embodiment of the sharpener 1. In the case of this embodiment, a closed supporting frame 31 is once again formed from the supporting wings 25, 26. However, the ends 30 of the supporting wings 25, 26, rather than being connected directly to one another, are each integrally formed on the outer circumference 35 of an insertion sleeve 36, which is arranged coaxially with the guide sleeve 4 and is offset axially in relation to the latter, with the result that the blade holder 5 is accommodated between the guide sleeve 4 and the insertion sleeve 36. The insertion sleeve 36 is provided with a bore 37 into which a drive shaft 38 (FIG. 16) of an automatic sharpener can be inserted. In order to form an effective torque-transmitting form-fitting connection between such a drive shaft 38 and the sharpener body 2, the bore 37 has a non-circular cross section. In the exemplary embodiment illustrated, the cross section of the bore 37 is designed in the form of a circle segment, as can be gathered in FIG. 17 and 18 in particular.

Figure 15:
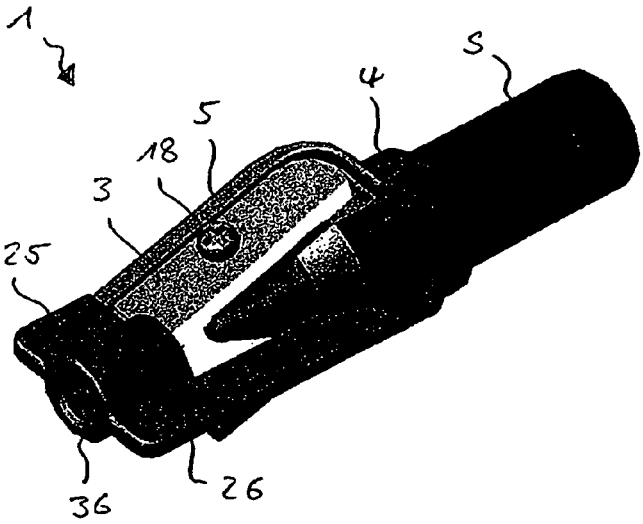
FIG. 15 shows a perspective illustration of the sharpener according to FIG. 12.

FIG. 15 shows a perspective illustration of the fourth exemplary embodiment of the sharpener (FIGS. 12 to 14) with a pencil S introduced into the sharpening position in the guide sleeve 4.

The sharpener 1 can advantageously be used for different functions. For example, all the exemplary embodiments of the sharpener 1 which are illustrated can be used as an open manual sharpener. Furthermore, as a result of its compact form, the sharpener 1 can also advantageously be used as a cutting unit of a crank-handle-operated or motor-operated automatic sharpener. The fourth exemplary embodiment (FIGS. 12 to 14) is particularly suitable for this purpose.

Figure 16:
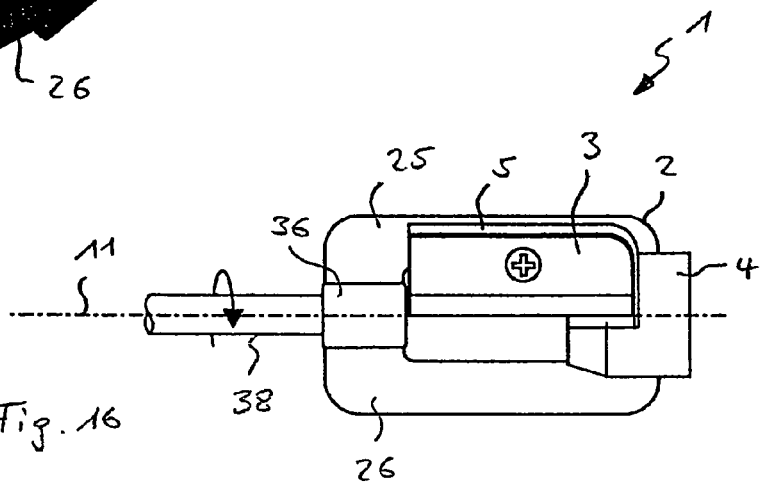
FIG. 16 shows, in a plan view which has been rotated in relation to FIG. 12, the sharpener according to FIG. 12 and the drive shaft of an automatic sharpener, the drive shaft having been drive-connected to the sharpener according to FIG. 12.

FIG. 16 shows this exemplary embodiment of the sharpener 1 together with the drive shaft 38 of the automatic sharpener (not illustrated specifically) inserted into the insertion sleeve 36.

Figure 17:
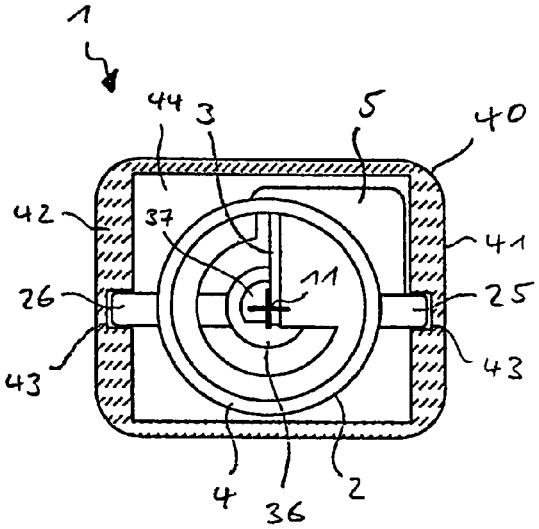
FIG. 17 shows a cross section of a shaving-collecting housing of the sharpener, and an axial plan view of the sharpener body according to FIG. 12 inserted into the shaving-collecting housing.
Figure 18:
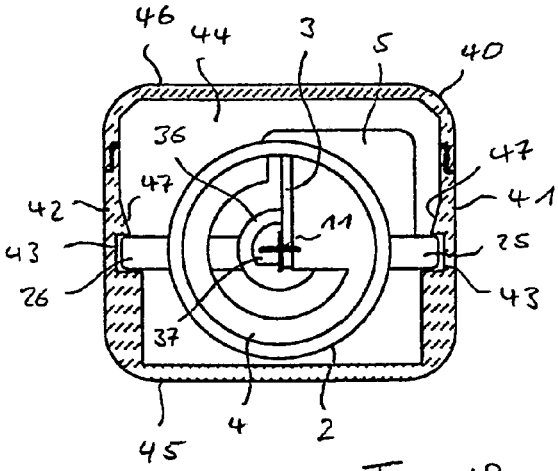
FIG. 18 shows an illustration according to FIG. 17 of the sharpener with an alternative configuration of the shaving-collecting housing.

The sharpener 1 optionally comprises, in addition, a shaving-collecting housing 40, in which the sharpener body 2 is accommodated (FIGS. 17 and 18). In order to secure the sharpener body 2, the shaving-collecting housing 40 has two guide grooves 43 which are introduced parallel to one another in opposite side walls 41 and 42 of the housing a corresponding supporting wing 25 or 26 being positioned in a form-fitting manner in each guide groove 43. The sharpener 1 formed in such a manner has the advantage, in particular, that the sharpener body 2, rather than—as is customary—being constructed on a base of the shaving-collecting housing 40, hangs in the interior 44 of the shaving-collecting housing. As a result, the pencil-guiding channel 7 is, once again, largely open in the direction of the interior 44 of the shaving-collecting housing 40, this ensuring particularly good discharge of the shaved-off core material.

FIGS. 17 and 18 show two preferred variants of the shaving-collecting housing 40 which differ, in particular, in respect of the fastening of the sharpener body 2. In the variant according to FIG. 17, the shaving-collecting housing 40 is configured in a single piece in cross section. The sharpener body 2 here is pushed into the shaving-collecting housing 40 along the guide grooves 43. In the variant according to FIG. 18, in contrast, the shaving-collecting housing 40 comprises a housing base 45 and a housing cover 46 which can be removed therefrom. In this variant, the sharpener body 2, with the housing cover 46 open, is inserted into the housing base 45 from above and thus transversely to the extent of the guide grooves 43. In order to facilitate insertion, that border of each guide groove 43 which is directed toward the housing cover 46 is formed by one or more latching noses 47, via which the corresponding supporting wing 25, 26 is latched into the guide groove 43.

Figure 19:
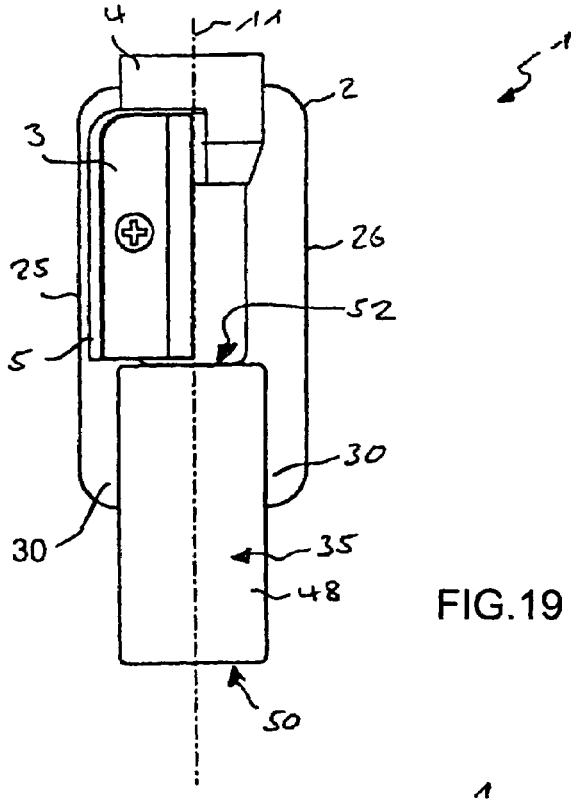
FIG. 19 shows a fifth embodiment of the sharpener, in an illustration according to FIG. 1.
Figure 20:
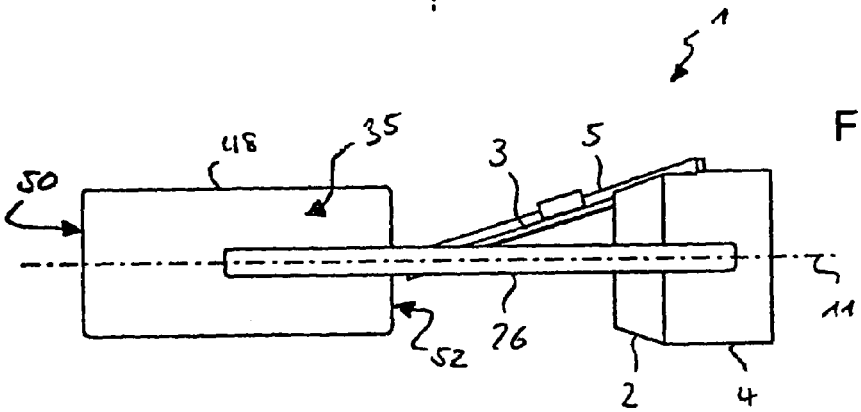
FIG. 20 shows the sharpener according to FIG. 19 in an illustration according to FIG. 2.
Figure 21:
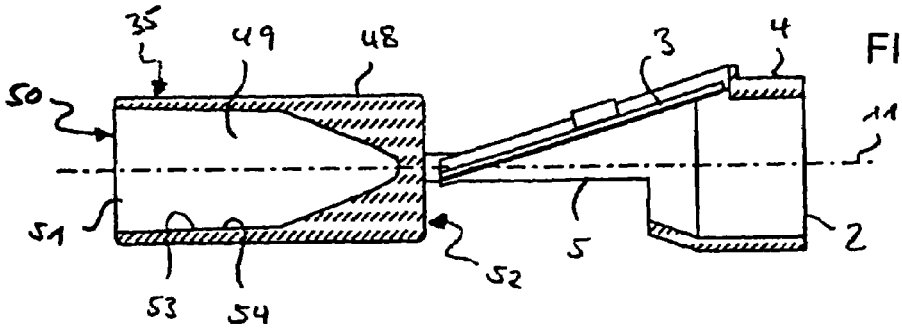
FIG. 21 shows the sharpener according to FIG. 19 in an illustration according to FIG. 3.

FIGS. 19 to 21 illustrate a fifth embodiment of the sharpener 1, in which, instead of the insertion sleeve 36 (according to FIG. 12), a protective cap 48 is provided for the pencil S. This protective cap 48 is provided with a mount 49 which is coaxial with the pencil-guiding channel 7 and opens out into an introduction opening 51 for the pencil S, this introduction opening being arranged at the end 50 of the protective cap 48 which is directed away from the guide sleeve 4. The introduction opening 51 of the protective cap 48 and the introduction end 8 of the guide sleeve 4 are thus axially opposite one another. The protective cap 48 is closed at the axial end 52 which is directed toward the guide sleeve 4.

In order for the circumference of a pencil S which has been inserted into the protective cap 48 to be enclosed in an air-tight manner, an inner portion 53 of the protective cap 48, this inner portion being adjacent to the introduction opening 51, is designed as a sealing cone 54, i.e. as a wall portion which tapers slightly in the direction of the end 52.

LIST OF DESIGNATIONS

1 Sharpener
2 Sharpener body
3 Shaving blade
4 Guide sleeve
5 Blade holder
6 Bore
7 Pencil-guiding channel
8 Introduction end
9 Outlet end
10 Portion
11 Axis
12 Portion
13 Outer circumference
14 Horizontal surface
15 Bearing surface
16 Positioning aid

17 Cutting edge
18 Fastening screw
19 Wedge tip
20 Wedge base
21 Shaving-discharge slot
22 Circumferential-angle range
25 Supporting wing
26 Supporting wing
27 End
28 Bottom surface
30 End
31 Supporting frame
35 Outer circumference
36 Insertion sleeve
37 Bore
38 Drive shaft
40 Shaving-collecting housing
41 Side wall of the housing
42 Side wall of the housing
43 Guide groove
44 Interior
45 Housing base
46 Housing cover
47 Latching nose
48 Protective cap
49 Mount
50 End
51 Introduction opening
52 End
53 Inner portion
54 Sealing cone
S Pencil

I claim:

1. A sharpener for a pencil, comprising:

a sharpener body and a shaving blade fastened thereon;

said sharpener body including a guide sleeve and a blade holder integrally formed on said guide sleeve;

said guide sleeve having a bore formed therein defining a pencil-guiding channel with a channel axis, an introduction end and an outlet end for the pencil;

said blade holder having a bearing surface positioned obliguely in relation to said channel axis of the pencil-guiding channel, projecting axially beyond said outlet end of said guide sleeve, and being configured for positioning said shaving blade; and said pencil-guiding channel being substantially open in a region receiving a tip of the pencil and towards a side of said sharpener body opposite said blade holder;

two supporting wings integrally formed substantially opposite one another on an outer periphery of said guide sleeve, projecting approximately radially from said guide sleeve in cross section and projecting axially beyond said outlet end of said guide sleeve, and said two supporting wings having ends directed away from said guide sleeve and connected to one another to form a supporting frame.

2. The sharpener according to claim 1, wherein said end of each of said supporting wings directed away from said guide sleeve is integrally formed on an outer periphery of an insertion sleeve for a drive shaft, and said insertion sleeve is disposed coaxially relative to said guide sleeve.

3. The sharpener according to claim 2, wherein said insertion sleeve has a substantially central bore with a non-circular cross section.

* * * * *